US012753975B2

(12) United States Patent
Spreemann et al.

(10) Patent No.: US 12,753,975 B2
(45) Date of Patent: Oct. 6, 2026

(54) CONTROLLABLE INJECTION FOR IMPLEMENTING DIFFERENT LOCAL REFRIGERANT DISTRIBUTION

(71) Applicant: Linde GmbH, Pullach (DE)

(72) Inventors: Jürgen Spreemann, Pullach (DE); Luis Matamoros, Pullach (DE); Florian Deichsel, Pullach (DE)

(73) Assignee: LINDE GMBH, Pullach (DE)

( * ) Notice: Subject to any disclaimer, the term of this patent is extended or adjusted under 35 U.S.C. 154(b) by 114 days.

(21) Appl. No.: 18/571,543

(22) PCT Filed: Jun. 15, 2022

(86) PCT No.: PCT/EP2022/025277
§ 371 (c)(1),
(2) Date: Dec. 18, 2023

(87) PCT Pub. No.: WO2022/268360
PCT Pub. Date: Dec. 29, 2022

(65) Prior Publication Data

US 2024/0288223 A1 Aug. 29, 2024

(30) Foreign Application Priority Data

Jun. 23, 2021 (DE) ..... 10 2021 003 245.4

(51) Int. Cl.
*F25J 5/00* (2006.01)
*F28D 7/02* (2006.01)
(Continued)

(52) U.S. Cl.
CPC ..... *F28D 7/024* (2013.01); *F25J 5/002* (2013.01); *F28F 13/06* (2013.01); *F25J 2280/02* (2013.01);
(Continued)

(58) Field of Classification Search
CPC ..... F25J 1/0022; F25J 1/0052; F25J 1/0055
See application file for complete search history.

(56) References Cited

U.S. PATENT DOCUMENTS 3,919,853 A * 11/1975 Rojey ..... F25J 1/0055 62/625
5,644,931 A * 7/1997 Ueno ..... F25J 1/0052 62/623
(Continued)

FOREIGN PATENT DOCUMENTS

EP 1367350 A1 * 12/2003 ..... F25J 1/0087
EP 2857782 A1 4/2015
(Continued)

*Primary Examiner* — Eric S Ruppert
(74) *Attorney, Agent, or Firm* — Millen, White, Zelano & Branigan P.C.; Ryan R. Pool

(57) ABSTRACT

A heat exchanger for indirectly transferring heat between a process medium and at least one first refrigerant, comprising: a shell which surrounds a shell space and extends along a longitudinal axis; and a pipe bundle which is disposed in the shell space and extends along the longitudinal axis of the shell from a lower end to an upper end of the pipe bundle in the shell space; wherein: the pipe bundle has a plurality of first pipes for receiving the first refrigerant; the first pipes are wound helically onto a core pipe of the heat exchanger. According to the invention, the first pipes each have an end which is formed by at least one nozzle via which the first refrigerant can be introduced into the shell space, the ends being disposed along the longitudinal axis of the shell at different heights.

16 Claims, 5 Drawing Sheets

(51) Int. Cl.
*F28F 13/06* (2006.01)
*F28D 21/00* (2006.01)

(52) U.S. Cl.
CPC ... *F25J 2290/32* (2013.01); *F28D 2021/0033* (2013.01)

(56) References Cited

U.S. PATENT DOCUMENTS

| | | | | |
|---|---|---|---|---|
| 5,832,745 | A * | 11/1998 | Klein Nagelvoort .. | F25J 1/0265 62/619 |
| 8,051,901 | B2 | 11/2011 | Schonberger et al. | |
| 9,726,434 | B2 | 8/2017 | Steinbauer et al. | |
| 2009/0301130 | A1* | 12/2009 | Schonberger ..... | F25J 5/007 62/614 |
| 2012/0240618 | A1* | 9/2012 | Vink ..... | F25J 1/0241 165/200 |
| 2013/0068431 | A1* | 3/2013 | Ho ..... | F25J 1/0022 165/163 |
| 2018/0245844 | A1 | 8/2018 | Spreemann et al. | |
| 2019/0063843 | A1 | 2/2019 | Steinbauer et al. | |

FOREIGN PATENT DOCUMENTS

| | | | |
|---|---|---|---|
| EP | 3428563 | A1 | 1/2019 |
| WO | 2017167458 | | 10/2017 |

* cited by examiner

CONTROLLABLE INJECTION FOR IMPLEMENTING DIFFERENT LOCAL REFRIGERANT DISTRIBUTION

The invention relates to a coil wound heat exchanger.

Such coil wound heat exchangers (CWHE for short) are often used as the core in natural gas liquefaction plants. A first refrigerant, which evaporates by means of a falling film, is introduced on the shell side. In this evaporation, a so-called maldistribution through the pipe bundle of the heat exchanger can occur, such that some pipes of the pipe bundle get too much, and other pipes too little, refrigerant. This maldistribution effect can change locally over the bundle height and thus has a different negative influence, depending upon the height.

Starting from this, the object of the present invention is therefore to provide a coil wound heat exchanger and a method which counteracts such losses in performance.

This object is achieved by a heat exchanger having the features of claim 1 and by a method having the features of claim 12. Advantageous embodiments of these aspects of the present invention are specified in the corresponding dependent claims and are described below.

According to claim 1, a heat exchanger for indirectly transferring heat between a process medium and at least one first refrigerant is disclosed, having:

- a shell which surrounds a shell space and extends along a longitudinal axis;
- a pipe bundle which is disposed in the shell space and extends along the longitudinal axis of the shell from a lower end to an upper end of the pipe bundle in the shell space, wherein the pipe bundle has a plurality of first pipes for receiving the first refrigerant which are disposed in different pipe layers, wherein the first pipes are wound helically onto a core pipe of the heat exchanger, which core pipe extends along the longitudinal axis of the shell in the shell space.

According to the invention, it is provided for the first pipes to each have an end which is formed by at least one nozzle via which the first refrigerant can be introduced or injected into the shell space, e.g., as a two-phase flow (liquid/gaseous), wherein the ends are disposed along the longitudinal axis of the shell at different heights between the lower end and the upper end of the pipe bundle, and wherein in particular the first pipes belong to different pipe layers of the pipe bundle. Preferably, each first pipe is disposed in a different pipe layer of the pipe bundle.

According to one embodiment of the heat exchanger, it is provided for the shell space to have a lower portion and an upper portion relative to the longitudinal axis (when the heat exchanger is disposed as intended, wherein the longitudinal axis extends along the vertical).

Furthermore, according to one embodiment of the invention, it is provided for the heat exchanger to have a first line which is guided into the lower portion of the shell space and is connected to the first pipes via a valve in each case, so that a volume flow of the first refrigerant introduced into the respective first pipe via the first line can be set by means of the respective valve. Thus, in the shell space, said first refrigerant can be injected into the shell space in a targeted manner at different heights with respect to the longitudinal axis or the vertical and in the radial direction of the pipe bundle in different pipe layers, in order to counteract a maldistribution of the first refrigerant in the shell space.

Furthermore, according to one embodiment of the heat exchanger, it is provided for the pipe bundle to have at least one second pipe which is connected to the first line, so that the first refrigerant can be introduced via the first line into the at least one second pipe of the pipe bundle and can be guided via the latter in particular from the lower portion into the upper portion of the shell space, wherein the at least one second pipe is fluidically connected to a second line guided out of the upper portion of the shell space, so that the first refrigerant can be withdrawn from the heat exchanger via the second line.

Furthermore, according to an alternative embodiment of the heat exchanger according to the invention, it is provided for the heat exchanger to have a first line which is guided from the upper portion of the shell space of the heat exchanger and is connected to the first pipes via a valve in each case, so that a volume flow of the first refrigerant introduced into the respective first pipe of the pipe bundle via the first line can be set by means of the respective valve.

According to one embodiment, it is furthermore preferably provided for the pipe bundle to have at least one second pipe which is connected to the first line, so that the first refrigerant can be introduced into the first line via the at least one second pipe, wherein the first line is connected to a second line downstream of said valves. The alternative embodiment thus differs from the embodiment described above in particular in that the first refrigerant is fed into the first pipes from the upper portion of the shell space, whereas, in the exemplary embodiment described above, it is introduced into the first pipes of the pipe bundle from the lower portion of the shell space.

According to a further embodiment of the heat exchanger according to the invention, it is provided for the pipe bundle to have further first pipes, each having an end that is formed by at least one nozzle via which the first refrigerant can be introduced or injected into the shell space, e.g., as a two-phase flow (liquid/gaseous), wherein the ends of the further first pipes are disposed along the longitudinal axis of the shell also at different heights between the lower end and the upper end of the pipe bundle (and wherein in particular the further first pipes belong to different pipe layers), and wherein the further first pipes are connected to the second line via a valve in each case, which valve is guided out of the upper portion of the shell space (see above), so that a volume flow of the first refrigerant introduced into the respective further first pipe via the second line can be set by means of the respective valve. The present exemplary embodiment thus differs from the two alternative embodiments described above in that the introduction of the first refrigerant into the first pipes of the pipe bundle or into the further first pipes of the pipe bundle takes place both from the lower portion of the shell space and from the upper portion of the shell space.

According to one embodiment, the first refrigerant can be a Joule-Thomson refrigerant (JT refrigerant for short), which becomes biphasic, or cools down, through injection into the shell space. However, it is also possible for the first refrigerant to be a different (non-JT) refrigerant which is injected from the warm side. If the first refrigerant is a JT refrigerant, it is preferably provided according to one embodiment for the second line to be returned into the upper portion of the shell space via a valve, so that the first refrigerant can be introduced into the upper portion of the shell space and can be injected there into the upper portion of the shell space.

According to one embodiment of the invention, it is furthermore provided for the pipe bundle to have at least one third pipe for receiving a second refrigerant, wherein the second refrigerant can be guided from the lower portion of the shell space into the upper portion of the shell space via the at least one third pipe. If the second refrigerant is a non-JT refrigerant, it is preferably withdrawn from the upper portion of the shell space (just like the process medium; see below).

If the first refrigerant guided in the first or in the further first pipes is a non-JT refrigerant, the second refrigerant can, for example, be configured as a JT refrigerant. In this case, according to one embodiment of the heat exchanger, it is preferably provided for the pipe bundle to have at least one third pipe for receiving a second refrigerant, wherein the second refrigerant can be guided from the lower portion of the shell space into the upper portion of the shell space via the at least one third pipe, and wherein the at least one third pipe is fluidically connected to a further line guided out of the upper portion of the shell space, so that the first refrigerant can be withdrawn from the heat exchanger via the further line, and wherein the further line is returned into the upper portion of the shell space via a valve, so that the second refrigerant can be introduced into the upper portion of the shell space and can be injected there into the upper portion of the shell space.

In principle, according to one embodiment of the heat exchanger, it is furthermore provided for the pipe bundle to have at least one fourth pipe for receiving the process medium to be cooled—in particular, natural gas—wherein the process medium can be guided from the lower portion of the shell space into the upper portion of the shell space via the at least one fourth pipe. Like the first or further first pipes, the second pipes, the third pipes, and the fourth pipes are also preferably wound helically around the core pipe of the heat exchanger. The core pipe serves in particular to remove the load of the pipes of the pipe bundle. During production of the pipe bundle, the pipes are wound onto the horizontally disposed core pipe.

A further aspect of the present invention relates to a method for indirectly transferring heat between a process medium—here, preferably natural gas—and at least one first refrigerant using a heat exchanger according to the invention, wherein the first refrigerant is injected into the shell space via the nozzles of the first pipes (and possibly via the nozzles of the further first pipes).

According to an authorized embodiment of the method, it is provided for a distribution of the first refrigerant in the shell space to be influenced by adjusting the valves associated with the first pipes both in the vertical direction (i.e., along the longitudinal axis) and in the radial direction of the pipe bundle.

According to one embodiment of the method, it is furthermore provided, alternatively or additionally, for a distribution of the first refrigerant in the shell space to be influenced by adjusting the valves associated with the further first pipes both in the vertical direction and in the radial direction of the pipe bundle.

According to a further embodiment of the method, it is provided for an injection of the first refrigerant via the second line into the upper portion of the shell space to be influenced by adjusting the second valve.

Further details and advantages of the invention shall be explained by the following description of figures of an exemplary embodiment with reference to the figures.

Figure 4:
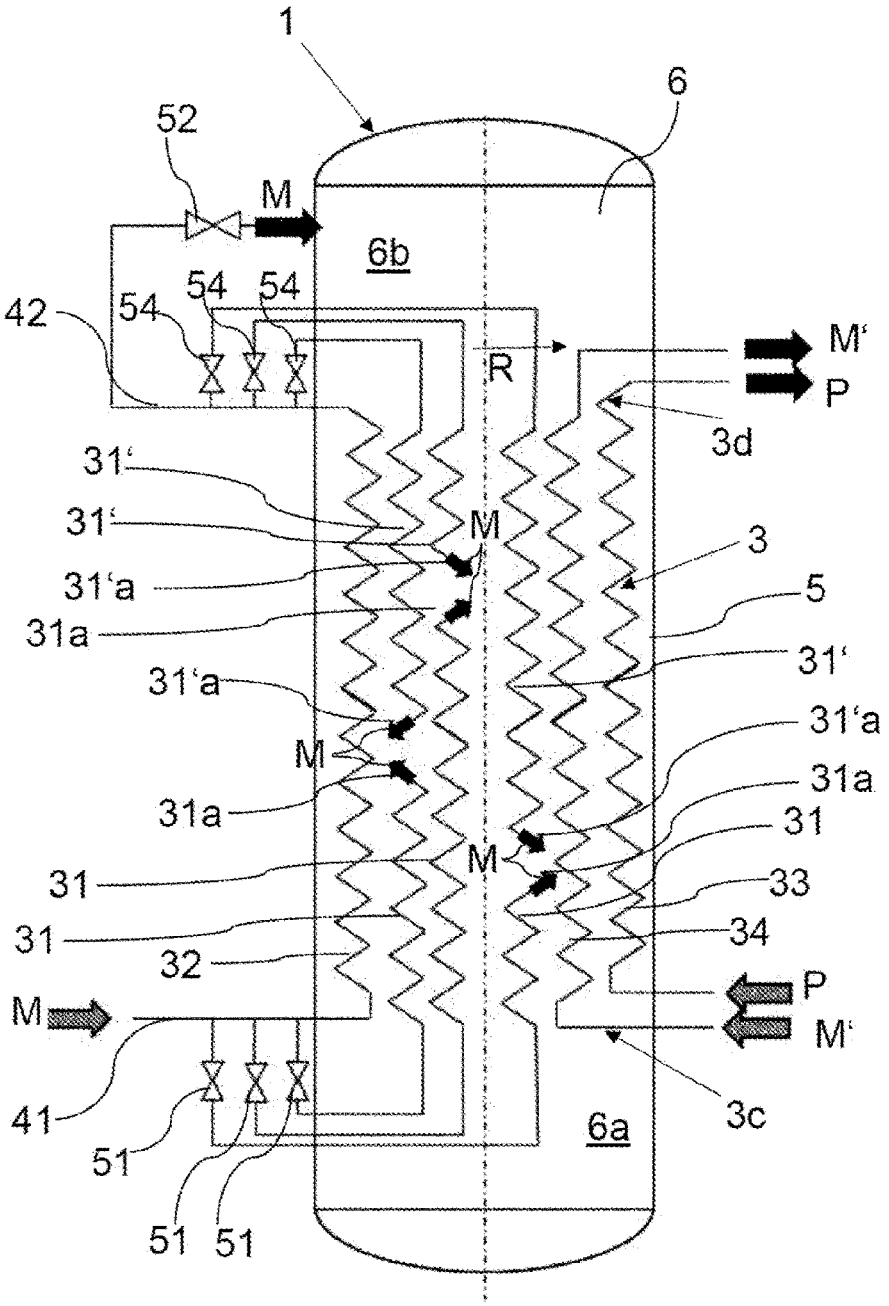
Figure 5:
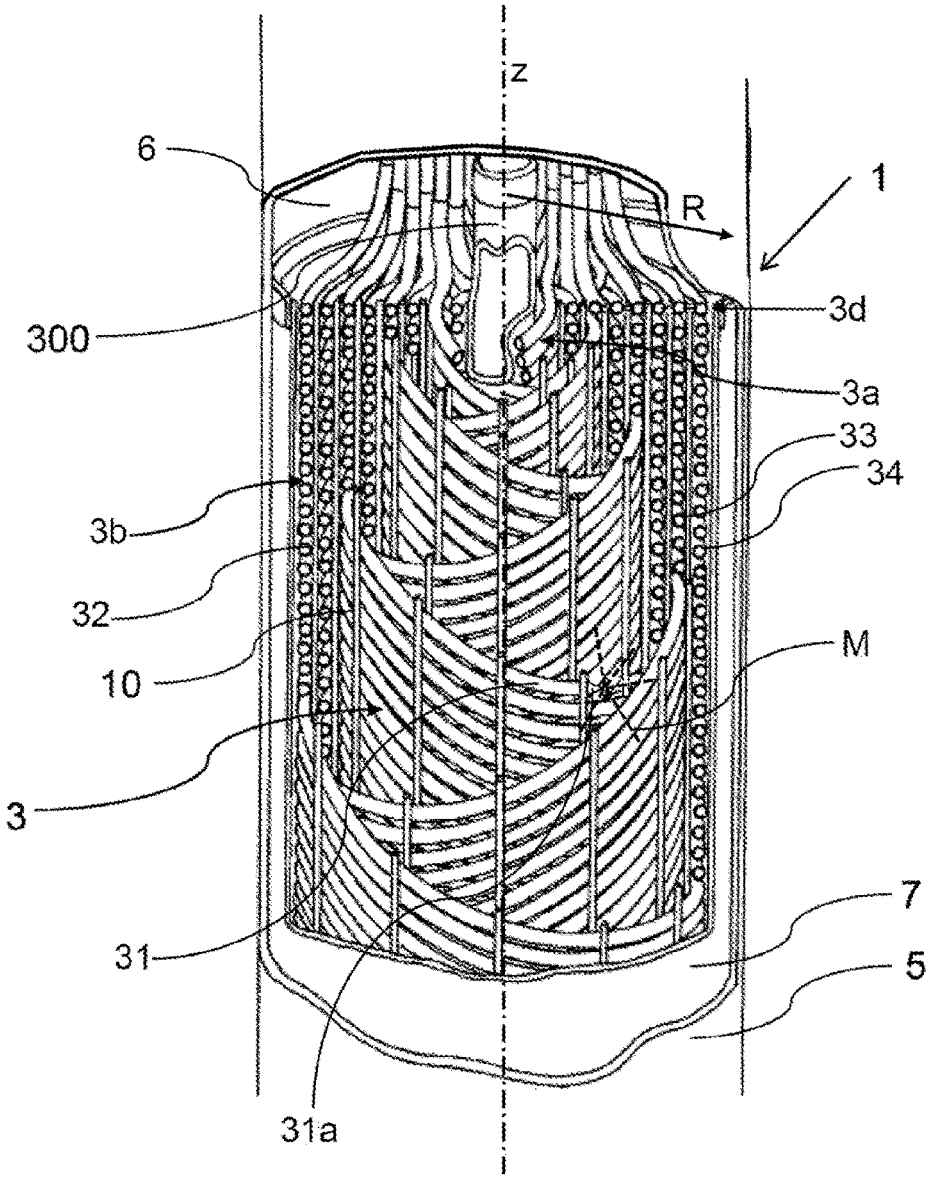

FIG. 4 shows an embodiments of a heat exchanger according to the invention, wherein a first refrigerant is introduced into the shell space both from below and from above and is introduced there into the shell space via ends of first pipes or further pipes of the pipe bundle at different heights and in different radial positions, wherein the first refrigerant is still injected into an upper portion of the shell space; and FIG. 5 shows a partially sectioned representation of a coil wound heat exchanger with a pipe bundle, which has several pipes wound onto a core pipe, wherein an end of a first pipe of the pipe bundle is shown by way of example, via which the first refrigerant is injected into the shell space.

Figure 1:
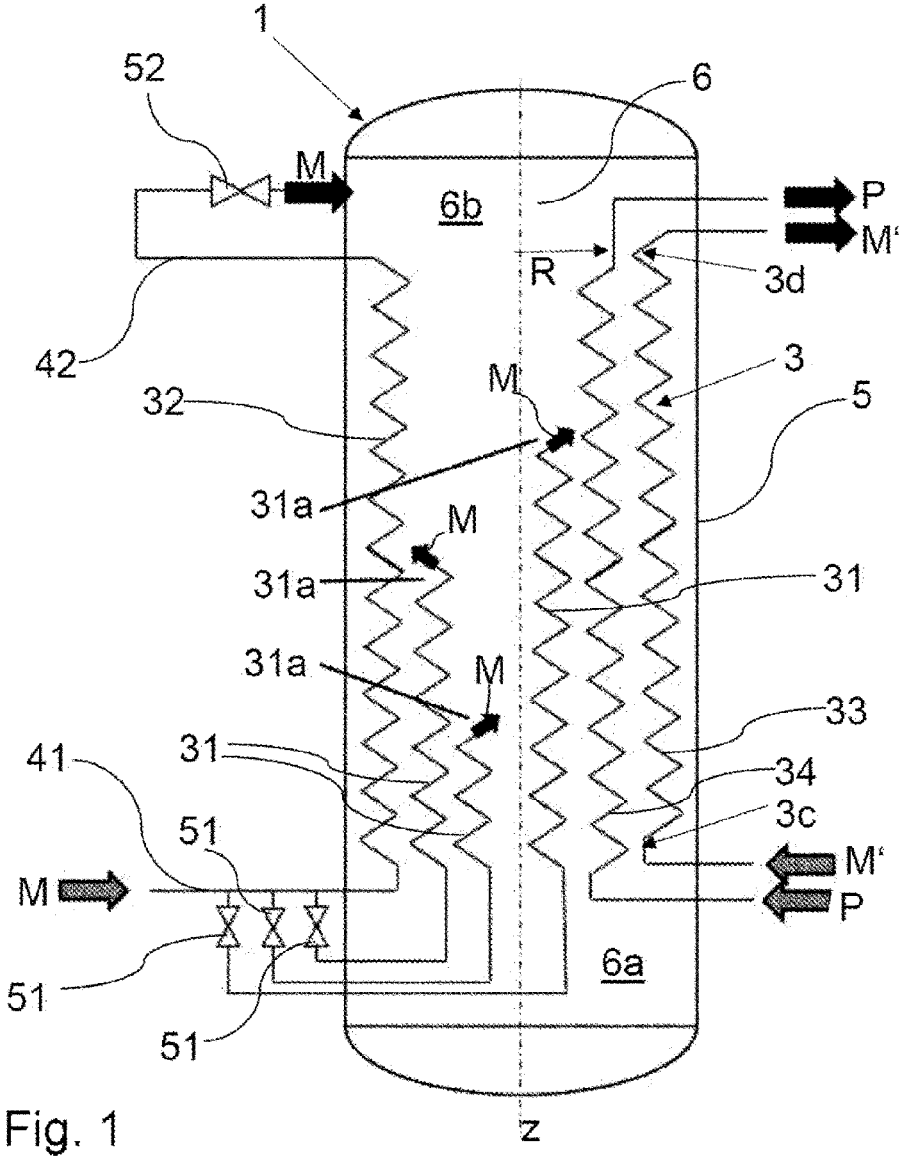
FIG. 1 shows an embodiments of a heat exchanger according to the invention, wherein a first refrigerant is introduced into the shell space from below and is introduced there into the shell space via ends of first pipes of the pipe bundle at different heights and in different radial positions, wherein the first refrigerant is still injected into an upper portion of the shell space.

FIG. 1 shows an embodiment of a coil wound heat exchanger 1 according to the invention. If such plants are used for liquefying a process medium P—in particular, natural gas—the natural gas to be cooled and liquefied is located in the pipe interior, i.e., in pipes 33 of a pipe bundle 3 of the heat exchanger 1 in indirect heat exchange with a first refrigerant M, which flows through a shell space 6 of the heat exchanger 1. Such heat exchangers 1 are generally oriented vertically, wherein the natural gas M to be cooled and liquefied flows from the bottom up in the pipe interior of the pipes 33, and the first refrigerant M is distributed in the shell space 6 as uniformly as possible from above. Due to the indirect heat exchange, the temperature of the natural gas P thus decreases from the bottom to the top over the height of the heat exchanger, whereas the temperature of the first refrigerant M in the shell space 6 increases to the same extent from top to bottom. However, irregularities in the distribution of the first refrigerant M onto the individual pipes 33 or in the distribution of the first refrigerant M in the shell space 6 can result in unwanted local differences in the temperature profile between individual pipes 33 or corresponding pipe layers.

Now, a continuous, controllable injection onto different bundle regions is realized, for example, according to the embodiment of a heat exchanger according to the invention shown in FIG. 1, in that individual first pipes 31 of the pipe bundle 3, which guide the first refrigerant M, are cut at different heights and layers during winding in the bundle 3, so that these first pipes 31 each receive an open end 31*a* acting as a nozzle. These first pipes 31 are then connected to at least one first line 41 and are connected to the main flow of the first refrigerant M by means of valves 51. In addition to the local feeding of the first refrigerant M via the ends 31*a*, the Joule-Thomson effect can also be used locally directly during injection.

FIG. 1 thus represents, in particular, an embodiment of the invention in which the first refrigerant M is used as a Joule-Thomson (JT) refrigerant which is supplied to the first pipes 31 from the warm end (from below).

The ends 31*a* of the first pipes 31, which in each case preferably form at least one nozzle via which the first refrigerant M can be introduced into the shell space 6, are characterized in particular in that they are disposed along the longitudinal axis z of the shell 5 of the heat exchanger 1 at different heights between a lower end 3*c* and an upper end 3*d* of the pipe bundle 3 and are preferably disposed in different pipe layers of the pipe bundle also in the radial direction R of the pipe bundle 3. In this way, the distribution of the first refrigerant M in the shell space 6 can be influenced in a targeted manner by adjusting the individual valves 51. The first refrigerant can, for example, be a mixed refrigerant. The first refrigerant can, for example, have one or more of the following substances: $N_2$, methane, ethane, butane, propane, pentenes. Furthermore, a third refrigerant can also be guided in the pipe bundle (depending upon the process application).

As can be seen from FIG. 1, the first line 41 is guided into a lower portion 6*a* of the shell space 6 and is preferably connected to each first pipe 31 of the pipe bundle 3 via a valve 51 in each case, so that a volume flow of the first refrigerant M exiting the respective end 31*a* can be controlled or regulated separately. This principle is preferably also applied in the other embodiments which are described further below.

It is furthermore preferably provided (cf. FIG. 1) for the pipe bundle 3 to have at least one second pipe 32 which is connected to the first line 41, so that the first refrigerant M can be introduced into the at least one second pipe 32 of the pipe bundle 3 via the first line 41, wherein the at least one second pipe 32 is fluidically connected to a second line 42 which is guided out of an upper portion 6*b* of the shell space 6, so that the first refrigerant M can be withdrawn from the heat exchanger 1 via the second line 42, wherein the second line 42 is returned into the upper portion 6*b* of the shell space 6 via a valve 52, so that the first refrigerant M can be injected into the upper portion 6*b* of the shell space 6 in order to introduce the first refrigerant M to the pipe bundle 3 from above.

Furthermore, the pipe bundle 3 according to FIG. 1 preferably has at least one third pipe 33 for receiving a second refrigerant M', wherein the second refrigerant M' can be guided from the lower portion 6*a* of the shell space 6 into the upper portion 6*b* of the shell space 6 via the at least one third pipe 33 and there can be withdrawn from the heat exchanger 1. The second refrigerant M' can, in particular, exchange heat indirectly with the process medium or natural gas P. The process medium or natural gas P can be guided from the lower portion 6*a* of the shell space 6 into the upper portion 6*b* of the shell space 6 via at least one fourth pipe 34 of the pipe bundle 3, whence it can be withdrawn from the heat exchanger 1. In the embodiments described herein, the heat exchanger 1 preferably has several first, further first, second, third, and fourth pipes 31, 31', 32, 33, 34. The pipes 31, 31', 32, 33, 34 of the pipe bundle 3 are each preferably wound helically onto a core pipe 300 of the heat exchanger 300, which core pipe is shown by way of example in FIG. 5. This arrangement of the pipes 31, 31', 32, 33, 34 preferably applies to all embodiments of the heat exchanger 1 described herein.

Figure 2:
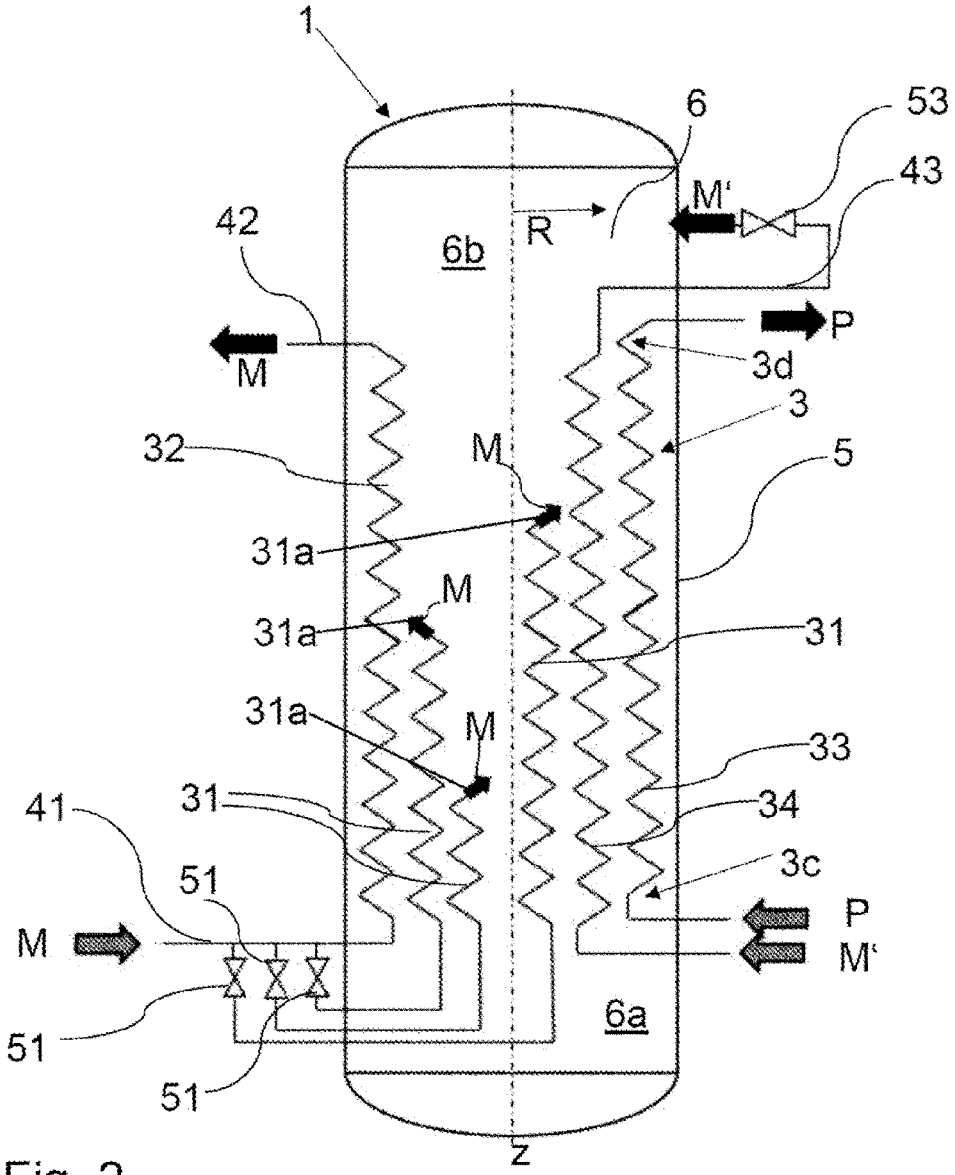
FIG. 2 shows an embodiments of a heat exchanger according to the invention, wherein a first refrigerant is introduced into the shell space from below and is introduced there into the shell space via ends of first pipes of the pipe bundle at different heights and in different radial positions, wherein a second refrigerant is still injected into an upper portion of the shell space.

Furthermore, FIG. 2 shows an embodiment of the invention in which the first refrigerant M is not the JT flow of the heat exchanger. In this case, the first refrigerant M may be a refrigerant which is used for cooling only in the liquefier or subcooler of the plant. In FIG. 2, the first refrigerant M, which, in contrast to FIG. 1, is not a JT refrigerant, is thus introduced from the warm side of the heat exchanger 1. In this case, analogously to FIG. 1, the first refrigerant M is guided into the lower portion 6*a* of the shell space 6 via a first line 41 and is preferably connected to each first pipe 31 of the pipe bundle 3 via a valve 51 in each case, so that a volume flow of the first refrigerant M exiting the respective end 31*a* can be again controlled or regulated separately. According to FIG. 2, the pipe bundle 3 furthermore has at least one second pipe 32 which is connected to the first line 41, so that the first refrigerant M can be introduced into the at least one second pipe 32 of the pipe bundle 3 via the first line 41, wherein the at least one second pipe 32 is fluidically connected to a second line 42 guided out of the upper portion 6*b* of the shell space 6, so that the first refrigerant M can be withdrawn from the heat exchanger 1 via the second line 42.

Furthermore, the pipe bundle 3 according to FIG. 2 preferably has at least one third pipe 33 for receiving a second refrigerant M', wherein the second refrigerant M' can be guided from the lower portion 6*a* of the shell space 6 into the upper portion 6*b* of the shell space 6 via the at least one third pipe 33 and there can be withdrawn from the heat exchanger 1. The second refrigerant M' can, in particular, exchange heat indirectly with the process medium or natural gas P. The process medium or natural gas P can be guided from the lower portion 6*a* of the shell space 6 into the upper portion 6*b* of the shell space 6 via at least one fourth pipe 34 of the pipe bundle 3, whence it can be withdrawn from the heat exchanger 1.

As can also be seen from FIG. 2, the at least one third pipe 33 for the second refrigerant M' is fluidically connected to a further line 43 guided out of the upper portion 6*b* of the shell space 6, so that the second refrigerant M' can be withdrawn from the heat exchanger 1 via the further line 43, wherein the further line 43 is returned into the upper portion 6*b* of the shell space 6 via a valve 53 so that the second refrigerant M' can be injected into the upper portion 6*b* of the shell space 6.

Figure 3:
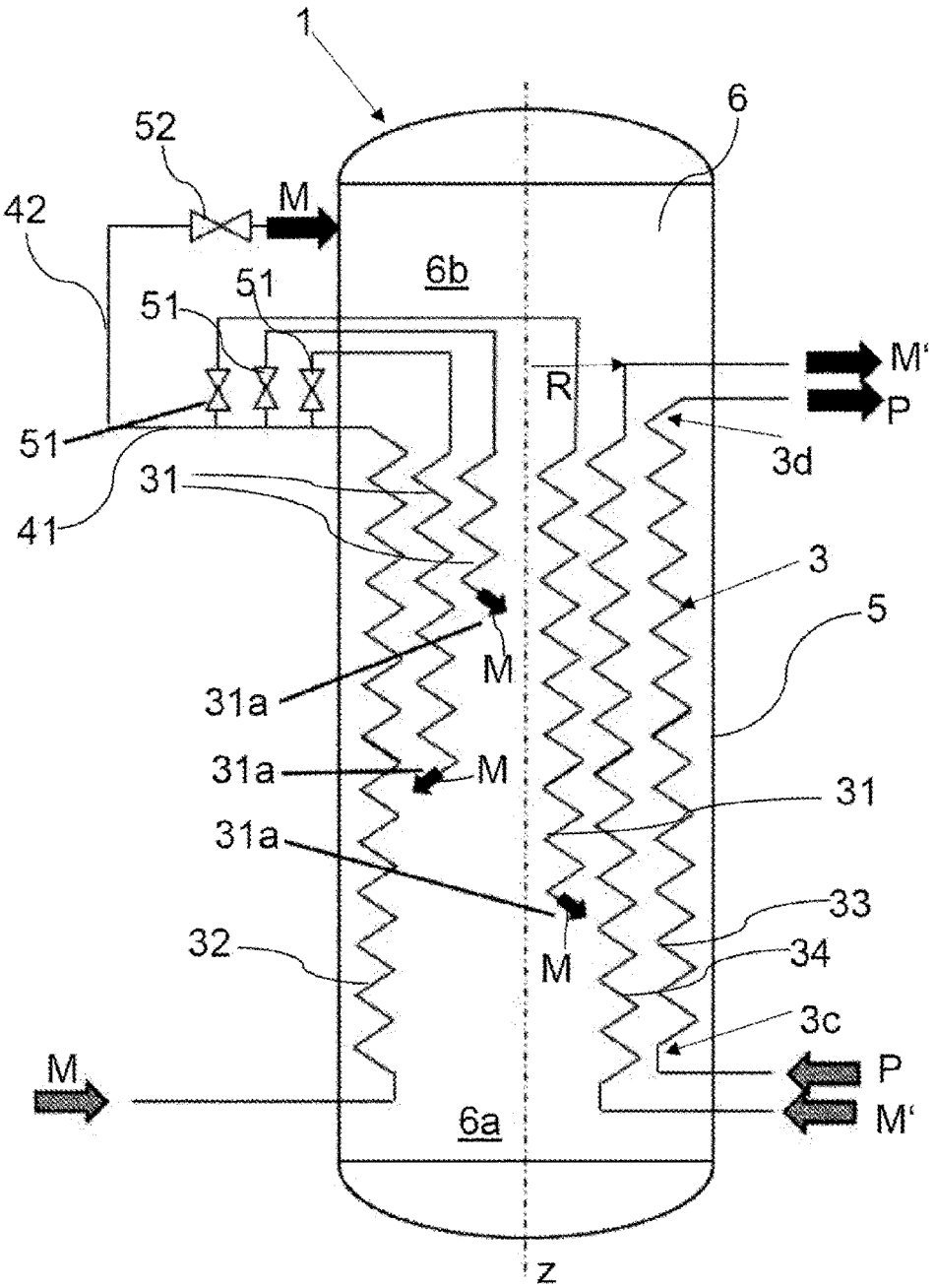
FIG. 3 shows an embodiments of a heat exchanger according to the invention, wherein a first refrigerant is introduced into the shell space from above and is introduced there into the shell space via ends of first pipes of the pipe bundle at different heights and in different radial positions, wherein the first refrigerant is still injected into an upper portion of the shell space.

FIG. 3 shows a further embodiment of the invention, wherein, here, in contrast to the embodiments according to FIGS. 1 and 2, the first refrigerant M is supplied from above to the relevant bundle region between the upper end 3*d* and the lower end 3*c*, i.e., from the cold side of the heat exchanger 1, wherein FIG. 3 shows, in particular, the situation in which the first refrigerant M is the cold high-pressure refrigerant (from the pipe side). Alternatively (not shown in FIG. 3), a distribution of the refrigerant can also take place via the low-pressure side (shell side).

According to FIG. 3, it is provided, in particular, for the pipe bundle 3 of the heat exchanger 1 to have at least one second pipe 32 which is supplied with the first refrigerant M from the lower end of the heat exchanger 1, wherein the at least one second pipe 32 in the shell space 6 is guided into the upper portion 6*a* and is connected there to a first line 41 which is guided out of the upper portion 6*a* of the shell space 6 and which is also connected to the first pipes 31 via a valve 51 in each case, so that a volume flow of the first refrigerant M introduced into the respective first pipe 31 via the first line 41 can be set by means of the respective valve 51 and can be guided in the respective first pipe 31 from top to bottom and to the respective end 31*a* or nozzle 31*a* and there can be introduced into the shell space M. The first line 41 is furthermore connected to a second line 42, or merges into it, downstream of the valves 52, wherein said second line 42 according to FIG. 3 is returned to the upper portion 6*b* of the shell space 6 via a valve 52, so that the first refrigerant M can continue to be injected into the upper portion 6*b* of the shell space 6 and can be introduced to the pipe bundle 3 from above. As already described above, the pipe bundle 3 furthermore has at least one third pipe 33 for receiving a second refrigerant M', wherein the second refrigerant M' can be guided from the lower portion 6*a* of the shell space 6 into the upper portion 6*b* of the shell space 6 via the at least one third pipe 33. During this process, the second refrigerant M' can indirectly exchange heat with the process medium P or natural gas P, which can be guided in at least one fourth pipe 34 of the pipe bundle from the lower portion 6*a* of the shell space 6 into the upper portion 6*b* of the shell space 6 and there can be withdrawn from the heat exchanger 1. In the embodiments according to FIGS. 1 through 4, it is preferably provided in each case for the process medium or natural gas P to be each guided in a direct current from bottom to top in the shell space 6 of the heat exchanger in the respective pipe 33, 34 of the pipe bundle 3.

FIG. 4, finally, shows a development of the embodiment shown in FIG. 1, in which further first pipes 31' of the pipe bundle 3 are provided in addition to the first pipes 31 of the pipe bundle 3, which first pipes 31' also each have an end 31'*a* which is formed by at least one nozzle via which the first refrigerant M can be introduced into the shell space 6, wherein the ends 31'*a* of the further first pipes 31' along the longitudinal axis z of the shell 5 are also disposed at different heights between the lower end 3*c* and the upper end 3*d* of the pipe bundle 3 and are preferably also located in different pipe layers. In this case, the further first pipes 31' are also connected to the second line 42 via a valve 54 in each case, so that a volume flow of the first refrigerant M introduced into the respective further first pipe 31' via the second line 42 can be set by means of the respective valve 54. In the further first pipes 31', the first refrigerant M is guided from top to bottom in the shell space 6. Downstream of the valves 54, the first refrigerant M, as shown in FIG. 1, can be returned into the upper portion 6*b* of the shell space 6 via the second line 42 and the valve 52. The second refrigerant M and the process medium or natural gas P can be guided in the third and fourth pipes 33, 34 of the pipe bundle 3 according to FIG. 1.

The invention can be applied, for example, in a coil wound heat exchanger 1 of the kind shown in FIG. 5. As shown by way of example in FIG. 5, the heat exchanger 1 has a shell 5, which extends along the longitudinal axis z (which is vertical during operation) and surrounds a shell space 6 of the heat exchanger 1, which serves to receive the first refrigerant M, wherein the pipe bundle 3 is disposed in the shell space 6. The pipe bundle 3 has several pipes 31, 32, 33, 34 that are disposed in pipe layers which are disposed one above the other in the radial direction R starting from an innermost pipe layer 3*a* and which end with an outermost pipe layer 3*b*. The pipes 31, 32, 33, 34 are wound around a core pipe 300 extending along the longitudinal axis z and disposed in the shell space 6, wherein FIG. 5 shows the embodiment according to FIG. 3 by way of example, in which the first pipes 31 guide and inject the first refrigerant M into the shell space from above. The corresponding valves and lines of the heat exchanger 1 outside the shell 5 are not shown in FIG. 5.

As is further indicated in FIG. 5, the pipes 31, 32, 33, 34 are wound around an outer side of the core pipe 300, with the interposition of webs 10. The core pipe 300 carries the load of the pipe bundle 3 downwards.

Furthermore, connecting pieces which are fluidically connected to the shell space 6 may be provided on the shell 5 which serve to introduce or withdraw the first medium M. The first medium M can be guided in the shell space 6 from top to bottom or from bottom to top.

In order to prevent a bypass flow of the first medium M past the pipe bundle 3 in the shell space 6, the pipe bundle 3 can be surrounded by a skirt 7.

LIST OF REFERENCE SIGNS

1 Heat exchanger
3 Pipe bundle
5 Shell
6 Shell space
3*a* Innermost pipe layer
6 Shell space
7 Skirt
10 Web
11 Gap
31 First pipe
31' Further first pipe
31*a* End or nozzle
32 Second pipe
33 Third pipe
34 Fourth pipe
41 First line
42 Second line
51, 52, 53, 54 Valve
300 Core pipe
M First refrigerant
M' Second refrigerant
R Radial direction
Z Axial direction or longitudinal axis
P Process medium—in particular, natural gas

The invention claimed is:

1. A heat exchanger for indirectly transferring heat between a process medium and at least one first refrigerant, comprising:

a shell which surrounds a shell space and extends along a longitudinal axis; and a pipe bundle which is disposed in the shell space and extends along the longitudinal axis of the shell from a lower end to an upper end of the pipe bundle in the shell space, wherein the pipe bundle comprises a plurality of pipes which are wound helically on a core tube in several pipe layers in a radial direction starting from an inner pipe layer to an outermost pipe layer;

wherein the pipe bundle has a plurality of first pipes for receiving the first refrigerant, which first pipes are disposed in different pipe layers of the pipe bundle, wherein the first pipes are wound helically onto the core pipe of the heat exchanger, wherein the core pipe extends along the longitudinal axis (z) of the shell space, and the core pipe carries the load of the pipes of the pipe bundle, and wherein the first pipes each have an end which is formed by at least one nozzle via which the first refrigerant can be introduced into the shell space, wherein the ends are disposed along the longitudinal axis of the shell at different heights between the lower end and the upper end of the pipe bundle, and each nozzle is positioned within a layer of the several layers of the pipe bundle.

2. The heat exchanger according to claim 1, wherein the shell space has a lower portion and an upper portion relative to the longitudinal axis.

3. The heat exchanger according to claim 2, wherein the heat exchanger has a first line which is guided into the lower portion of the shell space and is connected to the first pipes via a valve in each case, so that a volume flow of the first refrigerant introduced into the respective first pipe via the first line can be set by means of the respective valve.

4. The heat exchanger according to claim 3, wherein the pipe bundle has at least one second pipe which is connected to the first line, so that the first refrigerant can be introduced into the at least one second pipe of the pipe bundle via the first line, and wherein the at least one second pipe is fluidically connected to a second line guided out of the upper portion of the shell space, so that the first refrigerant can be withdrawn from the heat exchanger via the second line.

5. The heat exchanger according to claim 2, wherein the heat exchanger has a first line which is guided out of the upper portion of the shell space and is connected to the first pipes via a valve in each case, so that a volume flow of the first refrigerant introduced into the respective first pipe via the first line can be set by means of the respective valve.

6. The heat exchanger according to claim 5, wherein the pipe bundle has at least one second pipe which is connected to the first line, so that the first refrigerant can be introduced into the first line via the at least one second pipe, wherein the first line is connected to a second line.

7. The heat exchanger according to claim 4, wherein the pipe bundle has further first pipes which each have an end which is formed by at least one nozzle via which the first refrigerant can be introduced into the shell space, wherein the ends of the further first pipes along the longitudinal axis of the shell are disposed at different heights between the lower end and the upper end of the pipe bundle, and wherein the further first pipes are each connected to the second line via a valve in each case, so that a volume flow of the first refrigerant introduced into the respective further first pipe via the second line can be set by means of the respective valve.

8. The heat exchanger according to claim 4, wherein the second line is returned into the upper portion of the shell space via a valve, so that the first refrigerant can be injected into the upper portion of the shell space.

9. The heat exchanger according to claim 2, wherein the pipe bundle has at least one third pipe for receiving a second refrigerant, wherein the second refrigerant can be guided from the lower portion of the shell space into the upper portion of the shell space via the at least one third pipe.

10. The heat exchanger according to claim 3, wherein the pipe bundle has at least one third pipe for receiving a second refrigerant, wherein the second refrigerant can be guided from the lower portion of the shell space into the upper portion of the shell space via the at least one third pipe, and wherein the at least one third pipe is fluidically connected to a further line which is guided out of the upper portion of the shell space, so that the second refrigerant can be withdrawn from the heat exchanger via the further line, and wherein the further line is returned into the upper portion of the shell space via a valve, so that the second refrigerant can be injected into the upper portion of the shell space.

11. The heat exchanger according to claim 2, wherein the pipe bundle has at least one fourth pipe for receiving the process medium to be cooled wherein the process medium can be guided from the lower portion of the shell space into the upper portion of the shell space via the at least one fourth pipe.

12. A method for indirectly transferring heat between a process medium and at least one first refrigerant using a heat exchanger according to claim 1, wherein the first refrigerant is injected into the shell space via the nozzles of the first pipes.

13. The method according to claim 12, wherein a distribution of the first refrigerant in the shell space is influenced by adjusting the valves associated with the first pipes both in the vertical direction and in the radial direction of the pipe bundle.

14. The method according to claim 12, wherein the pipe bundle has further first pipes which each have an end which is formed by at least one nozzle via which the first refrigerant can be introduced into the shell space, wherein the ends of the further first pipes along the longitudinal axis of the shell are disposed at different heights between the lower end and the upper end of the pipe bundle, and wherein the further first pipes are each connected to the second line via a valve in each case, and wherein a distribution of the first refrigerant in the shell space is influenced by adjusting the valves associated with the further first pipes both in the vertical direction and in the radial direction of the pipe bundle.

15. The method according to claim 14, wherein the second line is returned into the upper portion of the shell space via a second valve, and wherein an injection of the first refrigerant via the second line into the upper portion of the shell space is influenced by adjusting the second valve.

16. The method according to claim 12, wherein the process medium is natural gas.

* * * * *